US008580136B2

(12) United States Patent
Ohshiro et al.

(10) Patent No.: US 8,580,136 B2
(45) Date of Patent: Nov. 12, 2013

(54) ETCHING SOLUTION COMPOSITION FOR METAL THIN FILM CONSISTING PRIMARILY OF COPPER

(75) Inventors: Kenji Ohshiro, Tokyo (JP); Ryou Kouno, Tokyo (JP); Hideki Takahashi, Tokyo (JP)

(73) Assignee: Kanto Kagaku Kabushiki Kaisha, Tokyo (JP)

( * ) Notice: Subject to any disclaimer, the term of this patent is extended or adjusted under 35 U.S.C. 154(b) by 56 days.

(21) Appl. No.: 13/358,226

(22) Filed: Jan. 25, 2012

(65) Prior Publication Data

US 2012/0187087 A1 Jul. 26, 2012

(30) Foreign Application Priority Data

Jan. 25, 2011 (JP) ..... 2011-013120

(51) Int. Cl.

| | |
|---|---|
| ***B44C 1/22*** | (2006.01) |
| ***C03C 15/00*** | (2006.01) |
| ***C03C 25/68*** | (2006.01) |
| ***C23F 1/00*** | (2006.01) |

(52) U.S. Cl.
USPC ..... 216/106

(58) Field of Classification Search
USPC ..... 216/106
See application file for complete search history.

(56) References Cited

U.S. PATENT DOCUMENTS

| | | | |
|---|---|---|---|
| 7,008,548 | B2 | 3/2006 | Chae et al. |
| 2002/0081847 | A1 | 6/2002 | Jo et al. |
| 2007/0235685 | A1 | 10/2007 | Seki et al. |
| 2010/0120209 | A1 | 5/2010 | Choi et al. |

FOREIGN PATENT DOCUMENTS

| | | | | |
|---|---|---|---|---|
| JP | 2001-59191 | A | | 3/2001 |
| JP | 2002-140929 | A | | 5/2002 |
| JP | 2002-302780 | A | | 10/2002 |
| JP | 2003-55780 | A | | 2/2003 |
| JP | 2004-176115 | A | | 6/2004 |
| JP | 2004176115 | A | * | 6/2004 |
| JP | 2010-114415 | A | | 5/2010 |

* cited by examiner

*Primary Examiner* — Roberts Culbert
(74) *Attorney, Agent, or Firm* — Wolf, Greenfield & Sacks, P.C.

(57) ABSTRACT

The problem of the present invention is to provide an etching solution composition that can etch with high accuracy a metal-laminated film pattern comprising thin films of copper and a copper alloy, can form an excellent pattern shape, and has practically excellent and stable characteristics with long solution life, and to provide an etching method using such etching solution composition. The present invention relates to an etching method for etching a metal-laminated film having a layer consisting of copper and a layer consisting of a copper alloy containing copper, using an etching solution composition comprising phosphoric acid, nitric acid, acetic acid and water, as well as to said etching solution composition.

11 Claims, 3 Drawing Sheets

ETCHING SOLUTION COMPOSITION FOR METAL THIN FILM CONSISTING PRIMARILY OF COPPER

FIELD OF THE INVENTION

The present invention relates to an etching solution composition for a metal-laminated film having copper and a copper alloy consisting primarily of copper, which is used for the production of flat panel displays, etc., and to an etching method using such etching solution composition.

BACKGROUND OF THE INVENTION

As fine wiring materials for liquid crystal display apparatus, aluminum thin films have been conventionally used; however, in recent years, copper thin films having a characteristic of lower resistance than that of aluminum are attracting attention (see Patent Literatures 1 and 2).

Conventionally, copper has been used as a metal material for patterning printed wiring boards. However, until recently, copper or copper alloys consisting primarily of copper have not been used for the formation of fine patterns and driving-transistor electrodes with a line width of several micrometers or less in flat panel displays. Accordingly, to date, there has been only a limited range of etching technology for copper thin films with a line width of several micrometers or less, suitable for the production of flat panel displays.

When a copper thin film is used as an electrode, it is not that a copper monolayer is used, but metals such as Ti, Mo, MoTi should be used as a contact layer or barrier layer in order to improve the contact property with glass substrates and to block the dispersion of copper. In such cases, generally, laminated films of Ti/Cu/Ti, Cu/Ti, Mo/Cu/Mo, Cu/Mo, MoTi/Cu/MoTi, and Cu/MoTi are attempted to be used for electrode.

Since dry etching of Cu is difficult, etching of Cu/Mo is carried out by etching using a peroxide such as hydrogen peroxide and peroxosulfuric acid as an oxidant, and that of Cu/Ti is carried out by etching using a peroxide such as hydrogen peroxide and peroxosulfuric acid as an oxidant as well as by an etching method wherein Cu and Ti are subjected to two types of wet etching, or by an etching method wherein Cu is wet-etched and Ti is dry-etched (Patent Literatures 3 and 4).

However, etching solutions using these peroxides have the following problems: i) because it contains peroxide, the etching solution becomes unstable and the supply by one solution becomes difficult in some cases, ii) the life of etching solution is short because decomposition of peroxide is accelerated due to Cu ions dissolved in the etching solution, iii) the peroxide accumulated in dead space or in waste liquid has a risk of explosion, iv) in dry etching, particles tend to generate easily and yield may be reduced, and etching devices with depressurized specification are expensive.

Therefore, an etching process enabling excellent etching patterns without the use of an etching solution comprising peroxide, has been awaited.

An excellent etching pattern here refers to an even etch, such as that the etching accuracy of the line width of etched metal is high, the shape of pattern edge is sharp, and a tapered-shape pattern is formed. When the shape of a pattern edge is irregular and not sharp, then problems such as braking of wires and short-circuiting occur; when a tapered-shape pattern is not obtained, then the step coverage in the next step of thin-film formation deteriorates.

In wet etching of aluminum that has been conventionally used as a wiring material, there is a method using an etching solution of phosphoric acid, nitric acid and acetic acid. However, when such an etching solution is attempted to be used for metals other than aluminum, various factors including etch rate, corrosion potential, contact angle of etching solution with a resist and glass, and dispersion rate affect in a complex manner, making it difficult to obtain patterns having a tapered shape; therefore, application of this etching solution to the metals other than aluminum was only possible for limited objectives under restricted conditions.

The applicant of the present invention has found a method of etching a metal thin film of monolayer consisting primarily of silver, by using a specific composition of mixed acid of phosphoric acid, nitric acid and acetic acid (see Patent Literature 5); however, this method aims etching of the metal thin film of monolayer consisting primarily of silver, which is used as a material for repeller of reflective and semi-transmissive liquid crystal displays; and the method has not been examined for etching copper-laminated films for driving-transistor electrodes and fine patterns of flat panel displays.

Regarding laminated films of silver, a method for etching a laminated film consisting of silver or a silver alloy, in particular a laminated film of silver alloy and molybdenum, using a mixed acid of phosphoric acid, nitric acid and acetic acid has been disclosed (see Patent Literature 6). However, the method described in this literature needs to flow the etching solution to satisfy appropriate conditions, so as to adjust the etch rate of the silver alloy and molybdenum, thus requiring efforts to adjust the conditions, and since the etch rate under the flowing condition of mixed acid largely depends on the material properties of silver alloy and molybdenum, it is impossible to apply this method to other metals without modification.

Moreover, there is a report of an etching solution composition to simultaneously etch a single film consisting of copper or copper alloy and multiple films of double layers or more consisting of said metals, using an etching solution composition comprising phosphoric acid, nitric acid and acetic acid (see Patent Literature 7); however, the layer of "copper alloy" in this literature is only exemplified by copper oxide (I) (CuO), and no concrete description is substantially made for alloys of copper with other metals; moreover, this literature does not relate to the control of taper angles, which is a very important factor in fine patterning.

Furthermore, a film of copper oxide (I) (CuO) has a problem in that its contact property with substrates deteriorates due to reduction of the oxide film, caused by hydrogen plasma treatment performed in the production process of TFT in the production process of flat panel displays.

As mentioned above, etching of laminated films involves influence of not only the difference in the etch rate between layers of metals and metal alloys, but also influence of cell action due to the difference in corrosion potential between layers; accordingly, it is very difficult to predict whether or not good pattern shapes can be obtained by etching, based on the etching solution and the metals used in the laminated films.

Other than the above, with respect to laminated films containing copper and copper alloys, various kinds of laminated films have been investigated as a candidate of next-generation films, including laminated films wherein copper alloys are Cu—Mo, Cu—Ti, Cu—Ca, Cu—Mg, Cu—Ca—O, Cu—Mg—O, Cu—Al, Cu—Zr, Cu—Mn, Cu—Ni—B, Cu—Mn—B, Cu—Ni—B, Cu—Si, Cu—Al, Cu—Mo, Cu—Al, Cu—Mg—B, Cu—Ti—B, Cu—Mo—B, Cu—Al—B, Cu—Si—B, Cu—Mg—Al, Cu—Mg—Al—O, etc., as well as laminated films containing copper and copper oxides (CuO); however, none of them has been found to be practically satisfactory, and early development of technologies for the fabrication of fine patterns has been awaited.

CITATION LIST

Patent Literature

[Patent Literature 1] JP A 2002-302780
[Patent Literature 2] JP A 2001-59191
[Patent Literature 3] JP A 2002-140929
[Patent Literature 4] US Patent Publication 7008548B2
[Patent Literature 5] JP A 2004-176115
[Patent Literature 6] JP A 2003-55780
[Patent Literature 7] JP A 2010-114415

SUMMARY OF THE INVENTION

As described above, laminated films are required to have a number of properties including excellent electrical properties and film stability during their fabrication process, and establishment of etching technology for them is also required. Of these, the present inventors have discovered that almost no investigation has been carried out on effective methods for etching laminated films comprising copper and copper alloys that are excellent in barrier property and contact property with a substrate such as glass, as well as on etching solutions used therein; and the inventors have realized that development of such an etching method and solution is an important issue. Namely, the problem of the present invention is to provide an etching solution composition that can etch with high accuracy a metal-laminated film pattern comprising copper and a copper alloy, can form an excellent pattern shape, and is practically excellent and stable and has long solution life; as well as to provide an etching method using such etching solution composition.

In order to solve the above problem, the present inventors have devoted themselves to investigations and found that the problem can be solved by using an etching solution composition comprising phosphoric acid, nitric acid, and acetic acid for etching a metal-laminated film that has a copper thin film and a copper alloy consisting primarily of copper as a contact layer and a barrier layer; after further promoting the research, the inventors have accomplished the present invention.

In certain embodiments, the present invention relates to the following:

(a) An etching method comprising etching a metal-laminated film comprising a layer consisting of copper and a layer consisting of a copper alloy comprising copper, using an etching solution composition comprising 40-50 wt % phosphoric acid, 1.5-3.5 wt % nitric acid, 25-40 wt % acetic acid and water, provided that the copper alloy is not an alloy consisting of copper and molybdenum and/or titanium.

(b) The etching method according to (a), wherein the metal-laminated film is composed of a layer configuration of copper/copper alloy/substrate or copper alloy/copper/copper alloy/substrate.

(c) The etching method according to (a) or (b), wherein the copper alloy is either copper-magnesium-aluminum or copper-magnesium-aluminum oxide.

(d) The etching method according to any one of the above (a) to (c), wherein copper-magnesium-aluminum alloy is obtained by sputtering a target material consisting of 0.1-10.0 atm % Mg, 0.1-10.0 atm % Al, and remaining percentage of Cu with unavoidable impurities.

(e) The etching method according to any one of the above (a) to (d), wherein the copper-magnesium-aluminum oxide alloy is an alloy that is obtained by sputtering said target material under the condition of oxygen partial pressure of 0.1-20%.

(f) The etching method according to any one of the above (a) to (e), wherein the etching takes place at an etch rate of 300-600 nm/min.

(g) The etching method according to any one of the above (a) to (f), wherein the etching takes place at a temperature of 20-40° C.

(h) The etching method according to any one of the above (a) to (g), wherein the etching produces a taper angle within a range of 20-80 degrees.

(i) The etching method according to any one of the above (a) to (h), wherein the taper angle is within a range of 30-60 degrees.

(j) The etching method according to any one of the above (a) to (i), wherein the substrate is glass, silicon, ceramic, or a resin including polyimide.

(k) The etching method according to any one of the above (a) to (j), wherein the etching solution further comprises a surfactant.

(l) An etching solution composition for etching a metal-laminated film that has a layer consisting of copper and a layer consisting of a copper alloy comprising copper (excluding an alloy consisting of copper and molybdenum and/or titanium), wherein the etching solution composition comprises 42-50 wt % phosphoric acid, 2.0-3.0 wt % nitric acid, 30.0-35.0 wt % acetic acid and water.

(m) The etching solution composition according to (l), wherein the metal-laminated film is composed of a layer configuration of copper/copper alloy/substrate or copper alloy/copper/copper alloy/substrate.

(n) The etching solution composition according to (l) or (m), for etching a driving-transistor electrode in a flat panel display.

(o) The etching solution composition according to any one of (l) to (n), wherein the copper alloy is either copper-magnesium-aluminum or copper-magnesium-aluminum oxide.

Methods described herein enable sufficient etching of a metal-laminated film comprising copper and a copper alloy consisting primarily of copper, without generating residues, using an etching solution composition comprising a specific composition ratio of phosphoric acid, nitric acid and acetic acid. In addition, although its mechanism has not yet been known, the present etching solution composition can suppress the etch rate while maintaining the level of etching activity, thereby providing excellent pattern shape. Accordingly, the etching solution composition of the present invention enables highly accurate etching of a metal-thin-film fine pattern with a line width of 0.5-5 μm on a metal-laminated film comprising copper and a copper alloy consisting primarily of copper, and ideal tapered shape can be obtained in the metal-thin-film fine patterns. In particular, regarding the laminated film wherein the copper alloy is copper-magnesium-aluminum or copper-magnesium-aluminum oxide, this copper-laminated film is attracting the highest attention from the present inventors from the viewpoint of contact property and barrier property, and a fine pattern can be successfully formed by the etching solution composition of the present invention.

In certain embodiments, when more than 20 wt % of acetic acid is contained in a composition of the present invention, a lack of homogenous etching due to over-etching of copper was not observed, thus achieving excellent effects by the simple composition.

As mentioned above, by the present invention, an etching method has been established, wherein a laminated film having a layer consisting of copper and a layer consisting of a copper alloy such as copper-magnesium-aluminum alloy and/or copper-magnesium-aluminum oxide alloy can be etched without using a peroxide, and accordingly, laminated films having not only high electrical properties, but also good barrier and contact properties, can be subjected to microfabrication, thus realizing a technological progress necessary for practical formation of fine patterns of copper with several μm or less, which has been highly demanded in the present technological area of flat panel displays.

In certain embodiments, the etching solution composition of the present invention has a wettablity, viscosity and specific gravity suitable for etching metal-laminated films comprising copper and a copper alloy consisting primarily of copper, and moreover, it shows an appropriate ratio of the etch rate for the copper to the etch rate for the copper alloy consisting primarily of copper.

In certain embodiments, the etching solution composition of the present invention does not exhibit a difference in the etch result between agitation condition and still-standing condition during etching of metal-laminated films having copper and a copper alloy consisting primarily of copper.

DETAILED DESCRIPTION OF CERTAIN EMBODIMENTS

Figure 1:
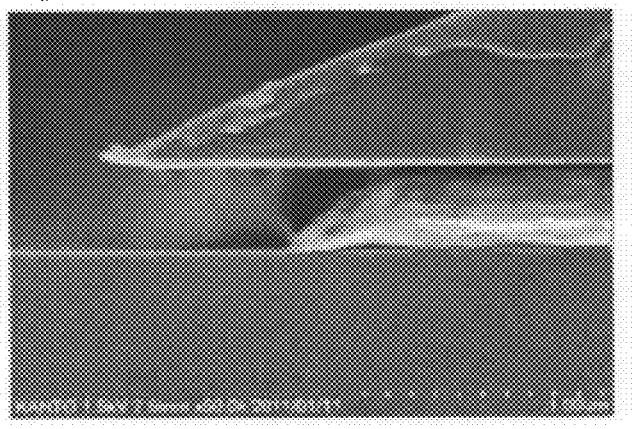
FIG. 1 Cross sectional photograph of Example 1 (Cu/CuMgAl).
Figure 2:
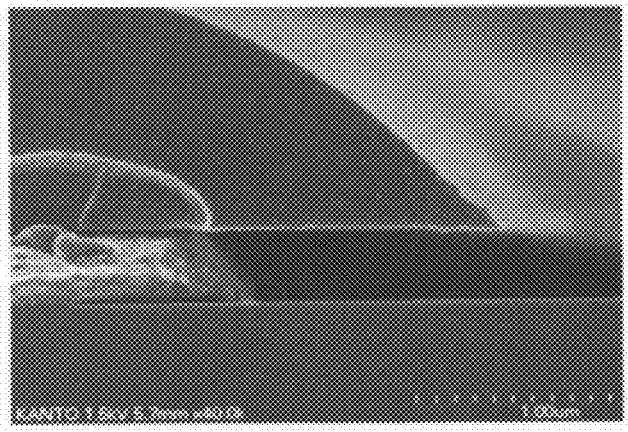
FIG. 2 Cross sectional photograph of Example 5. Etched under no-agitation condition.
Figure 3:
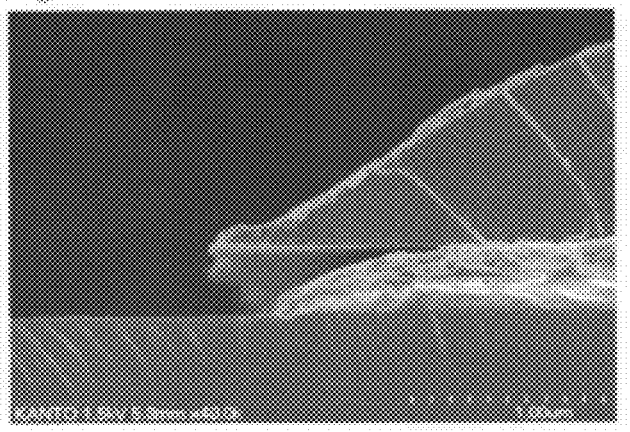
FIG. 3 Cross sectional photograph of Example 6. Etched under agitation condition.
Figure 4:
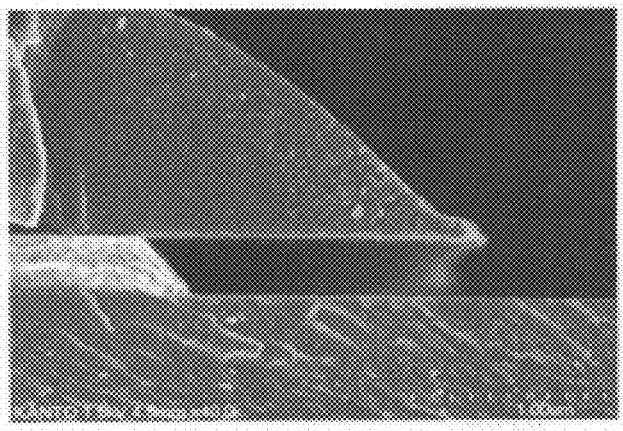
FIG. 4 Cross sectional photograph of Example 7 (Cu/CuMgAl/CuMgAlO). Etched under no-agitation condition.
Figure 5:
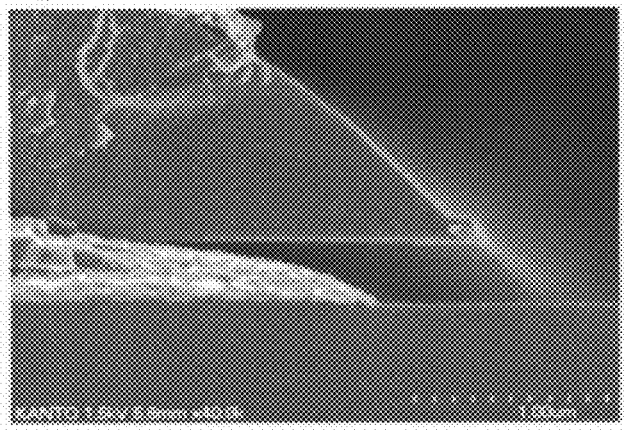
FIG. 5 Cross sectional photograph of Example 8 (Cu/CuMgAl/CuMgAlO). Etched under agitation condition.

Hereinafter, embodiments for carrying out the present invention are described in detail.

In one aspect, the present invention provides an etching method for etching a metal-laminated film that has a layer consisting of copper and a layer consisting of a copper alloy comprising copper (provided that the copper alloy is not an alloy consisting of copper and molybdenum and/or titanium), using an etching solution composition comprising 40-50 wt % phosphoric acid, 1.5-3.5 wt % nitric acid, 25-40 wt % acetic acid and water.

In the present invention, the copper alloy is an alloy that comprises copper as a major component and any metals, and preferably it comprises 80 atm % or more of copper. However, alloys consisting of copper and molybdenum and/or titanium are excluded.

The etching solution composition of the present invention is an etching solution composition wherein the concentration of phosphoric acid is 40-60 wt %, preferably about 42-50 wt %; the concentration of nitric acid is 1.5-4.0 wt %, preferably about 2.0-3.0wt %; and the concentration of acetic acid is 25.0-45.0 wt %, preferably about 30.0-35.0 wt %; this is used for highly accurate etching of a metal-laminated film pattern having copper and a copper alloy consisting primarily of copper.

When the concentrations of phosphoric acid and nitric acid are within the above ranges, accurate etching with a not-too-high etch rate and a small amount of side etching is possible. When the etch rate is high, while the etching activity is good, air bubbles generate during the etching reaction, leading to a cause of uneven etching, which is not preferred.

In addition, when the concentrations of phosphoric acid and nitric acid are within the above ranges, etching residues and uneven etching do not generate.

When the concentration of phosphoric acid is smaller or larger than the above range, uniformity in an area deteriorates and side etching tends to occur.

When the concentration of nitric acid is smaller than the above range, etching may not proceeds or may be halted; when it is larger than the above range, then etch rate becomes too high and fine etching becomes impossible.

When the concentration of acetic acid is smaller than the above range, etch rate is too high and fine etching cannot be achieved, and when it is larger than the above range, then a resist may peel off due to increased concentrations of organic substances.

In addition, when the concentration of acetic acid is within the above range, the corrosion potential of a metal-laminated film having copper and a copper alloy consisting primarily of copper can be maintained at a high level, and etching proceeds and no etching residues and irregular pattern-edge shapes are generated. Furthermore, depending on the concentration of acetic acid, in some cases problems such as high freezing point and induction of flammable characteristic may arise; however, when the acetic acid concentration is within the above range, such problems do not occur, which is preferable in terms of handling, production, environment and economy.

With the etching solution composition of the present invention, its etch rate is suppressed at a low level. Preferable etch rate is 300-600 nm/min. Accordingly, practically excellent etching properties can be obtained.

In addition, the etching temperature of the present etching solution composition is preferably 20-40° C. At low temperatures, etch rate is too low and a problem of too-long etching time occurs; at high temperatures, etch rate is too high and a problem of side etching, etc. occurs.

The etching method of the present invention is, in one embodiment, an etching method wherein the metal-laminated film has a layer configuration of copper/copper alloy, or copper alloy/copper/copper alloy.

The present etching method is suitable for etching laminated films having a layer configuration of copper/copper alloy, or copper alloy/copper/copper alloy.

The present etching method enables to control taper angles. The taper angle is within a range of 20-80 degrees, and preferably 30-60 degrees.

Here, the substrate is not limited, and examples may include any materials to be used as insulating materials or semiconductors which are desired to have a pattern formed on their surfaces, such as glass, silicon, ceramic, resins including polyimide; it is preferably glass or silicon.

The etching solution composition and the etching method of the present invention relate to an etching solution composition and an etching method used for etching driving-transistor electrodes in flat panel displays.

In one preferred embodiment, the present etching method exhibits particularly good etching properties for laminated films having new copper alloys, i.e., copper-magnesium-aluminum alloy and/or copper-magnesium-aluminum oxide. Here, the copper-magnesium-aluminum alloy is an alloy that is obtained by sputtering a target material consisting of 0.1-10.0 atm % Mg, 0.1-10.0 atm % Al, and remaining percentage of Cu with unavoidable impurities, which is a Cu alloy film used for wiring films. The copper-magnesium-aluminum oxide alloy is an alloy that is obtained by sputtering said target material under the condition of oxygen partial pressure of 0.1-20%.

When the laminated film is comprised of a layer consisting of copper and a layer consisting of copper-magnesium-aluminum alloy and/or copper-magnesium-aluminum oxide alloy, etching can be carried out by a simple etching process by means of the method of the present invention, without using a peroxide.

The etching method of the present invention has no risk of explosion caused by the generation of hydrogen due to the decomposition of hydrogen peroxide, because of the dissolution of the copper by etching accompanied by a catalyst activity of copper ions; and the etching properties of the solution do not deteriorate even when approximately 30,000 ppm of copper is dissolved, which leads to a long solution life.

Using the etching method of the present invention, laminated films having a layer of copper and a layer consisting of copper-magnesium-aluminum alloy and/or a layer consisting of copper-magnesium-aluminum oxide alloy, which must have conventionally been patterned with a hydrogen-peroxide etching composition, can be etched by an etching processing without using a peroxide, and fine patterning of copper with a several μm or less can be carried out much more safely and easily compared to conventional methods.

Moreover, the film of copper-magnesium-aluminum oxide alloy does not exhibit a problem of deterioration of contact property due to the reduction of the oxide film caused by hydrogen-plasma treatment performed during the production process of TFT in the production process of flat panel displays. (See Ulvac Technical Journal No. 71, 2009, p. 24-28).

With laminated films wherein the copper alloy is copper-molybdenum or copper-titanium which have been widely used generally, when the etching method of the present invention was applied under general conditions, good etching result could not be obtained, as shown in Comparative Examples 1-3. Moreover, among possible examples of copper alloy used in laminated films having copper and a copper alloy, including Cu—Ca, Cu—Mg, Cu—Ca—O, Cu—Mg—O, Cu—Al, Cu—Zr, Cu—Mn, Cu—Ni—B, Cu—Mn—B, Cu—Ni—B, Cu—Si, Cu—Al, Cu—Mo, Cu—Al, Cu—Mg—B, Cu—Ti—B, Cu—Mo—B, Cu—Al—B, Cu—Si—B, Cu—Mg—Al, and Cu—Mg—Al—O, preferable copper alloys for obtaining a good tapered shape by etching the laminated film using an etching solution composition comprising phosphoric acid, nitric acid and acetic acid include Cu—Mg—Al, and Cu—Mg—Al—O.

In addition, the present etching solution composition may further comprise one or more surfactants in order to improve its wettability for the surface to be etched. The surfactant is preferably an anionic or non-ionic surfactant.

Examples of the anionic surfactant include, as a fluorine surfactant, Ftergent 110 (Neos Co., Ltd.), EF-104 (Mitsubishi Materials Corporation), and examples of a non-fluorine surfactant include Persoft SF-T (NOF Corporation), etc.

In addition, examples of the non-ionic surfactant include EF-122A (Mitsubishi Materials Corporation) as a fluorine surfactant, and Ftergent 250 (Neos Co., Ltd) as a non-fluorine surfactant. Regarding the etching method using this etching composition, an immersion treatment of a substrate under the still-standing condition or agitation condition of liquid in a batch system can be applied, wherein the agitation being an agitation of the liquid itself or shaking of the substrate, or both.

EXAMPLES

In the following, the present invention is described in further detail with reference to Examples and Comparative Examples; however, the present invention is not limited to these examples.

Examples 1 and 2

A Cu alloy (Cu—Mg—Al) with a film thickness of 500 Å and Cu with a film thickness of 3000 Å were formed on a glass substrate, then a resist pattern was formed, after which the substrate was immersed in an etching solution of Table 1 (Examples 1 and 2) at a temperature of 30° C. for a period of 1.5 times the just-etching time. Then, the substrate was washed with water, dried, and observed by a microscope to evaluate the amount of side etching, tapered shape and residue after etching.

Results are shown in Table 1.

TABLE 1

| Cu/CuMgAl/glass substrate | | | | | | |
|---|---|---|---|---|---|---|
| | Phosphoric acid | Nitric acid | Acetic acid | Side etching amount | Tapered shape | Residue |
| Ex. 1 | 44% | 2.2% | 33% | 1 μm or less | Forward tapered shape | None |
| Ex. 2 | 44% | 3.0% | 33% | 1 μm or less | Forward tapered shape | None |

Examples 3 and 4

A Cu alloy (Cu—Mg—Al—O) with a film thickness of 500 Å and Cu with a film thickness of 3000 Å were formed on a glass substrate, then a resist pattern was formed, after which the substrate was immersed in an etching solution of Table 2 (Examples 3 and 4) at a temperature of 30° C. for a period of 1.5 times the just-etching time. Then, the substrate was washed with water, dried, and observed by a microscope to evaluate the amount of side etching, tapered shape and residue after etching.

Results are shown in Table 2.

TABLE 2

| Cu/CuMgAlO/glass substrate | | | | | | |
|---|---|---|---|---|---|---|
| | Phosphoric acid | Nitric acid | Acetic acid | Side etching amount | Tapered shape | Residue |
| Ex. 3 | 44% | 2.2% | 33% | 1 μm or less | Forward tapered shape | None |

TABLE 2-continued

| Cu/CuMgAlO/glass substrate | | | | | | |
|---|---|---|---|---|---|---|
| | Phosphoric acid | Nitric acid | Acetic acid | Side etching amount | Tapered shape | Residue |
| Ex. 4 | 44% | 3.0% | 33% | 1 μm or less | Forward tapered shape | None |

The etching solution composition of the present invention enables, by having a specific composition of phosphoric acid, nitric acid and acetic acid, highly accurate etching processing of metal-laminated film patterns consisting of copper/copper alloy or copper alloy/copper/copper alloy, with almost no etching residue, and excellent pattern shapes can be obtained, achieving high-yield production of highly reliable flat panel displays.

Examples 5-8

After forming a 500-Å Cu alloy film (Cu—Mg—Al) on a glass substrate, a 3000-Å Cu film o was formed, and a resist pattern was formed; on an another glass substrate, a 250-Å Cu alloy oxide film (Cu—Mg—Al—O) was formed, then a 250-Å Cu alloy film (Cu—Mg—Al) was formed, and a 3000-Å Cu film was formed, and a resist pattern was formed; these two types of substrates were immersed in the etching solution of Table 1 (Example 1) under no-agitation condition or with agitation by a stirrer at a number of rotation of 700 rpm, at a liquid temperature of 30° C. for a period of 1.5 times the just-etching time. Then, the substrates were washed with water, dried, and observed by a microscope to evaluate the amount of side etching, tapered shape and residue after etching. Table 3 shows the results.

TABLE 3

| Cu/CuMgAl/glass substrate, Cu/CuMgAl/CuMgAlO/glass substrate | | | | | |
|---|---|---|---|---|---|
| | Substrate | Agitation | Side etching amount | Tapered shape | Residue |
| Ex. 5 | Cu/CuMgAl/glass | No | 1.8 μm | Forward tapered shape | None |
| Ex. 6 | Cu/CuMgAl/glass | Applied | 1.8 μm | Forward tapered shape | None |
| Ex. 7 | Cu/CuMgAl/ CuMgAlO/glass | No | 1.6 μm | Forward tapered shape | None |
| Ex. 8 | Cu/CuMgAl/ CuMgAlO/glass | Applied | 1.6 μm | Forward tapered shape | None |

The etching solution composition of the present invention enables highly accurate etching processing of metal-laminated film patterns consisting of specific copper/copper alloy or copper/copper alloy/copper alloy oxide, with almost no etching residues, and excellent pattern shapes can be obtained, achieving high-yield production of highly reliable flat panel displays.

As mentioned above, the photographs of FIGS. 1-5 show etching results of Examples 1 and 5-8. In any photographs, etching patterns with an excellent tapered shape can be confirmed.

Comparative Example 1

On a glass substrate, a 500-Å Mo film was formed, and a 3000-Å Cu film was formed, then a resist pattern was formed. With this substrate, etching was carried out using the etching solution composition of Example 1 at a liquid temperature of 30° C., with immersion for a period of 1.5 times the just-etching time (etching time: 32 s). Then, the substrate was washed with water, dried, and observed by a microscope to evaluate the amount of side etching, tapered shape and residue after etching. Table 4 shows the results.

TABLE 4

| | Phosphoric acid | Nitric acid | Acetic acid | Side etching amount | Tapered shape | Residue | Photo |
|---|---|---|---|---|---|---|---|
| Com. Ex. 1 | 44% | 2.2% | 33% | 3.7 μm | Perpendicularly 2 steps, jaw-shaped lower Mo layer | None | FIG. 6 |

Figure 6:
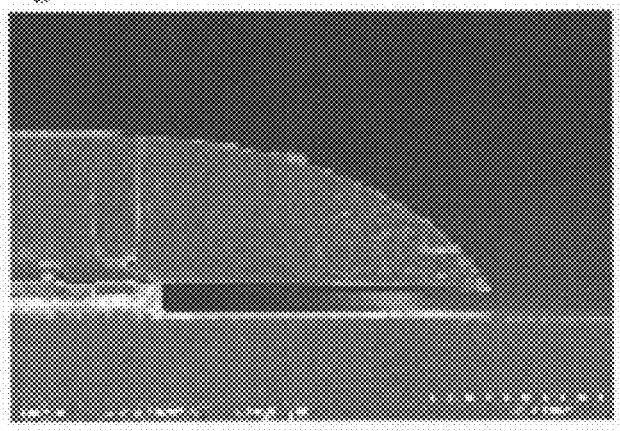
FIG. 6 Cross sectional photograph of Comparative Example 1. Etch time: 32 s, side etching amount: 3.7 μm.

As shown in the cross-sectional photograph of Comparative Example 1 in FIG. 6, the amount of side etching was 3.7 μm. When a Cu/Mo substrate is processed, since the etch rate of Cu layer is high, a large amount of side etching is generated; however, the lower Mo layer is not etched, which remains in a jaw shape; thus, a normal pattern cannot be formed.

Comparative Example 2

On a glass substrate, a 250-Å Mo film was formed, and a 4000-Å Cu film was formed, then a resist pattern was formed. With this substrate, etching was carried out using the etching solution composition of Comparative Example 2 at a liquid temperature of 35° C., with immersion for a period of 1.5 times the just-etching time (etching time: 30 s). Then, the substrate was washed with water, dried, and observed by a microscope to evaluate the amount of side etching, tapered shape and residue after etching. Table 5 shows the results.

TABLE 5

| | Phosphoric acid | Nitric acid | Acetic acid | Side etching amount | Tapered shape | Residue | Photo |
|---|---|---|---|---|---|---|---|
| Com. Ex. 2 | 65% | 2.1% | 21% | 4.6 μm | Perpendicularly 2 steps, jaw-shaped lower Mo layer | None | FIG. 7 |

Figure 7:
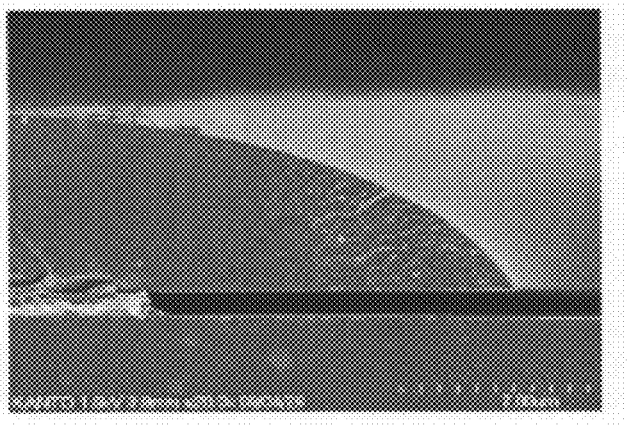
FIG. 7 Cross sectional photograph of Comparative Example 2. Etch time: 30 s, side etching amount: 4.6 μm.

As shown in the cross-sectional photograph of Comparative Example 2 in FIG. 7, the amount of side etching was 4.6 μm. When a Cu/Mo substrate is processed, since the etch rate of Cu layer is high, a large amount of side etching is generated. In addition, the lower Mo layer is not etched, which remains in a jaw shape; thus, a normal pattern cannot be formed.

Comparative Example 3

On a glass substrate, a 350-Å Ti film was formed, and a 4000-Å Cu film was formed, then a resist pattern was formed. With this substrate, etching was carried out using the etching solution composition of Example 1 at a liquid temperature of 30° C., with immersion for a period of 1.5 times the just-etching time (etching time: 20 s). Then, the substrate was washed with water, dried, and observed by a microscope to evaluate the amount of side etching, tapered shape and residue after etching. Table 6 shows the results.

TABLE 6

| | Phosphoric acid | Nitric acid | Acetic acid | Side etching amount | Tapered shape | Residue | Photo |
|---|---|---|---|---|---|---|---|
| Com. Ex. 3 | 44% | 2.2% | 33% | 1.9 μm | Upper Cu layer has tapered shape, lower Ti layer is insoluble. | — | FIG. 8 |

Figure 8:
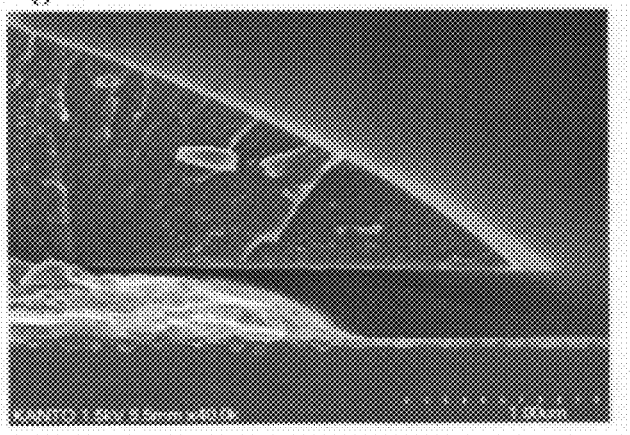
FIG. 8 Cross sectional photograph of Comparative Example 3. Etch time: 20 s, side etching amount: 1.9 μm.

As shown in the cross-sectional photograph of Comparative Example 3 in FIG. 8, the amount of side etching was 1.9 μm. When a Cu/Ti substrate is processed, while the Cu layer is soluble, the lower Ti layer cannot be etched at all and a normal pattern cannot be formed.

What is claimed is:

1. An etching method comprising:

etching a metal-laminated film comprising a layer consisting of copper and a layer consisting of a copper alloy comprising copper, using an etching solution composition comprising 40-50 wt % phosphoric acid, 1.5-3.5 wt % nitric acid, 25-40 wt % acetic acid and water, provided that the copper alloy is not an alloy consisting of copper and molybdenum and/or titanium.

2. The etching method according to claim 1, wherein the metal-laminated film is composed of a layer configuration of copper/copper alloy/substrate or copper alloy/copper/copper alloy/substrate.

3. The etching method according to claim 1, wherein the copper alloy is either copper-magnesium-aluminum or copper-magnesium-aluminum oxide.

4. The etching method according to claim 3, wherein copper-magnesium-aluminum alloy is obtained by sputtering a target material consisting of 0.1-10.0 atm % Mg, 0.1-10.0 atm % Al, and remaining percentage of Cu with unavoidable impurities.

5. The etching method according to claim 3, wherein the copper-magnesium-aluminum oxide alloy is an alloy that is obtained by sputtering said target material under the condition of oxygen partial pressure of 0.1-20%.

6. The etching method according to claim 1, wherein the etching takes place at an etch rate of 300-600 nm/min.

7. The etching method according to claim 1, wherein the etching takes place at a temperature of 20-40° C.

8. The etching method according to claim 1, wherein the etching produces a taper angle within a range of 20-80 degrees.

9. The etching method according to claim 8, wherein the taper angle is within a range of 30-60 degrees.

10. The etching method according to claim 1, wherein the substrate is glass, silicon, ceramic, or a resin including polyimide.

11. The etching method according to claim 1, wherein the etching solution further comprises a surfactant.

* * * * *